US005370541A

United States Patent [19]

Bossard

[11] Patent Number: 5,370,541

[45] Date of Patent: Dec. 6, 1994

[54] REPOSITIONABLE TERMINATION MODULE

[75] Inventor: Ronald G. Bossard, Austin, Tex.

[73] Assignee: Minnesota Mining and Manufacturing Company, St. Paul, Minn.

[21] Appl. No.: 8,656

[22] Filed: Jan. 25, 1993

[51] Int. Cl.[5] ..... H01R 13/44

[52] U.S. Cl. ..... 439/131; 439/676; 439/713

[58] Field of Search ..... 439/131, 387, 389, 402, 439/403, 507, 492, 498, 676, 701, 713

[56] References Cited

U.S. PATENT DOCUMENTS

| | | | |
|---|---|---|---|
| 3,798,587 | 3/1974 | Ellis, Jr. et al. . | |
| 4,099,823 | 7/1978 | D'Alessio | 439/713 X |
| 4,118,095 | 10/1978 | Berglund et al. . | |
| 4,290,664 | 9/1981 | Davis et al. . | |
| 4,303,296 | 12/1981 | Spaulding . | |
| 4,555,158 | 11/1985 | Lam . | |
| 4,585,290 | 4/1986 | Knickerbocker et al. . | |
| 4,684,195 | 8/1987 | Anderson et al. | 439/404 |
| 4,725,249 | 2/1988 | Blackwood et al. | 439/535 |
| 4,753,610 | 6/1988 | Eason et al. | 439/713 X |
| 4,763,226 | 8/1988 | Pelletier | 439/131 X |
| 4,815,988 | 3/1989 | Scherer | 439/392 |
| 4,820,192 | 4/1989 | Deakmann et al. | 439/404 |
| 4,863,393 | 9/1989 | Ward et al. | 439/188 |
| 4,878,848 | 11/1989 | Ingalsbe | 439/76 |
| 4,929,192 | 5/1990 | Beghelli | 439/131 X |
| 4,964,812 | 10/1990 | Seimon et al. | 439/403 |
| 4,986,626 | 1/1991 | Bossard | 350/96.2 |
| 4,986,762 | 1/1991 | Keith | 439/131 |
| 5,052,775 | 10/1991 | Bossard et al. | 385/76 |
| 5,083,941 | 1/1992 | Rodgers et al. | 439/716 X |
| 5,114,356 | 5/1992 | Taybl et al. | 439/131 X |
| 5,158,480 | 10/1992 | Blondeel et al. | 439/676 X |
| 5,228,872 | 7/1993 | Liu | 439/676 X |

*Primary Examiner*—Khiem Nguyen
*Attorney, Agent, or Firm*—Gary L. Griswold; Walter N. Kirn; Jack V. Musgrove

[57] ABSTRACT

An interconnection module for providing connections between a plurality of incoming conductors and a field connector has a termination block which is repositionable between storage and installation positions. The module includes a housing having a base and a cover removably attached to the base, the housing retaining a receptacle, such as a telephone jack, and a plurality of jumper wires connected between the termination block and the receptacle. The termination block, wires and receptacle collectively comprise a preterminated connector assembly which is completely removable from the housing. The termination block is generally planar, affording a low-profile module when placed in the storage position, parallel to the bottom of the housing. In the installation position, the termination block is rotated perpendicular to the bottom of the housing, making the capped upper edge of the termination block more accessable for installation of the incoming conductors. The base is designed to support and stabilize the termination block in the installation position.

14 Claims, 5 Drawing Sheets

REPOSITIONABLE TERMINATION MODULE

BACKGROUND OF THE INVENTION

1. Field of the Invention

The present invention generally relates to connectors for electrical wiring, and more particularly to a termination module for a plurality of wires preterminated in a modular connector, such as for telecommunications lines.

2. Description of the Prior Art

Prior art electrical connectors include a class in which a plurality of wires are preterminated in a single connector. Examples of such connectors are shown in U.S. Pat. Nos. 3,798,587, 4,118,095, 4,725,249, 4,863,393, and 4,964,812. Multi-wire, pre-terminated connectors may also be housed in termination modules, which may include several such connectors. See, e.g., U.S. Pat. Nos. 4,290,664, 4,303,296, 4,820,192 and 4,878,848.

One problem with multi-wire connectors relates to their size. It is desirable to optimize the size to allow a large density of connections, and further to make the connector body as small as possible so as to compactly fit in a conduit, closure or termination module. As a result of increasingly smaller size in preterminated connectors, it has become more difficult to install the connectors manually. Other consequences are that connectors are often fixed to a housing or closure in a preterminated position and orientation, making it difficult or impossible to modify the general structure of the connection, and that some connector bodies in a multi-connector module must be retained even if they are not in use. This prevents usage of the otherwise empty space by a different type of connector or component. Finally, the foregoing problems are amplified when trying to design a very low-profile module. and some low-profile connectors do not allow detachment of the connector components after connection. It would, therefore, be desirable and advantageous to devise a low-profile interconnection module providing improved ergonomics in the installation operation, and which further allows for the remateable attachment of distribution lines from within the module.

SUMMARY OF THE INVENTION

The present invention provides a repositionable termination module generally comprising a housing having one or more connector assemblies therein, each assembly including a plurality of wires, the wires being preterminated at one end in a receptacle or jack, and preterminated at the other end in a termination block which is retained in the housing. The termination block may be moved between installation and storage positions to facilitate connection of the preterminated wires to incoming conductors. The housing has an opening for receiving the receptacle and an entrance channel for the incoming conductors, and the base of the housing may provide multiple mounting locations for the termination block. By providing a termination block which is generally planar and movable between two positions 90° apart, the module may be made low-profile and still accommodate the repositionable aspect of the termination block. The storage position of the block may also be designed to isolate the conductors from adjacent components, such as in a mixed-media termination module. The connector assembly is further completely removable from the module, and may easily be retrofitted into existing termination modules.

BRIEF DESCRIPTION OF THE DRAWINGS

The novel features and scope of the invention are set forth in the appended claims. The invention itself, however, will best be understood by reference to the accompanying drawings, wherein:

DESCRIPTION OF THE PREFERRED EMBODIMENT

Figure 1:
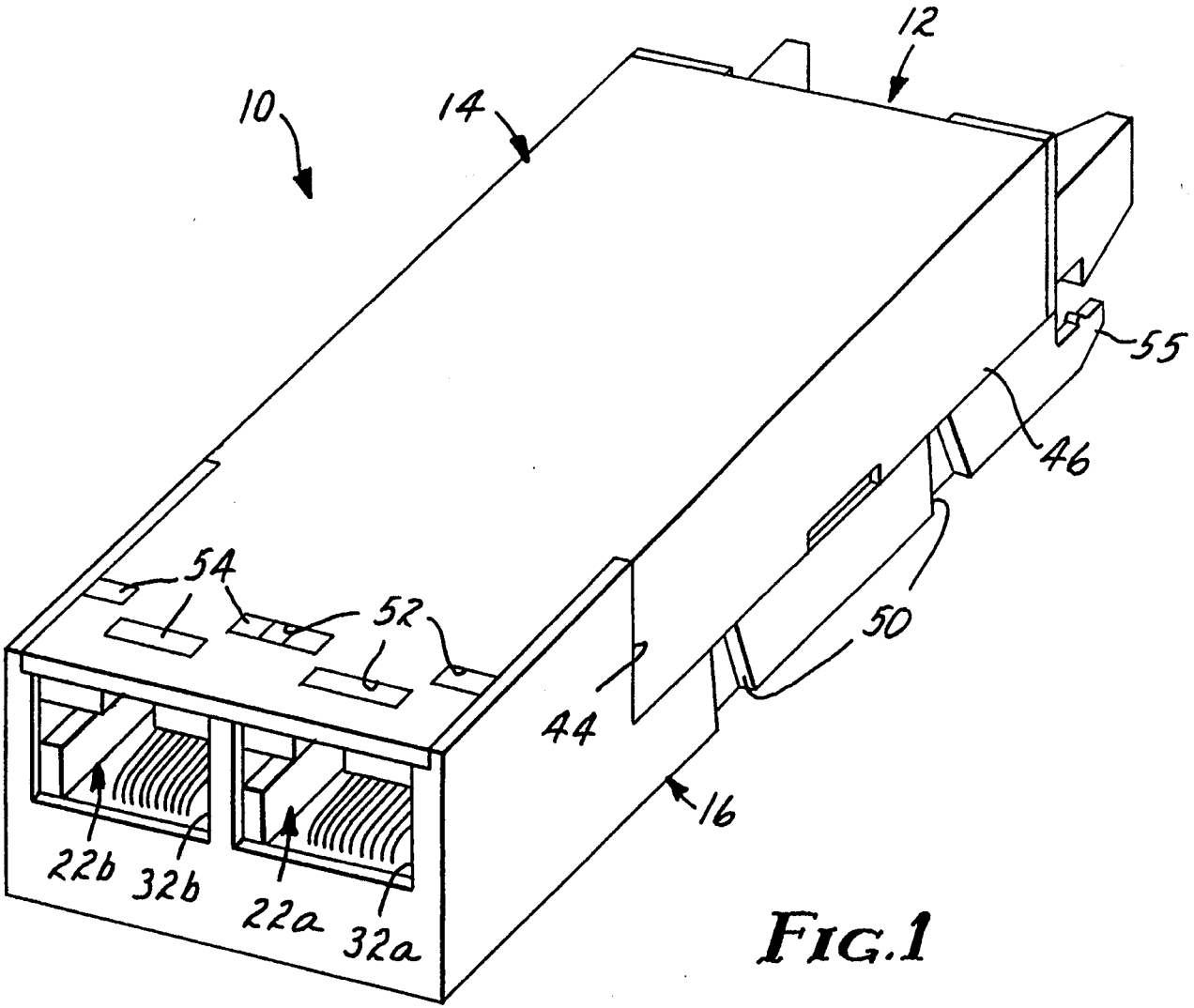
FIG. 1 is a front perspective view of one embodiment of the fully assembled, repositionable termination module (RTM) of the present invention.
Figure 2:
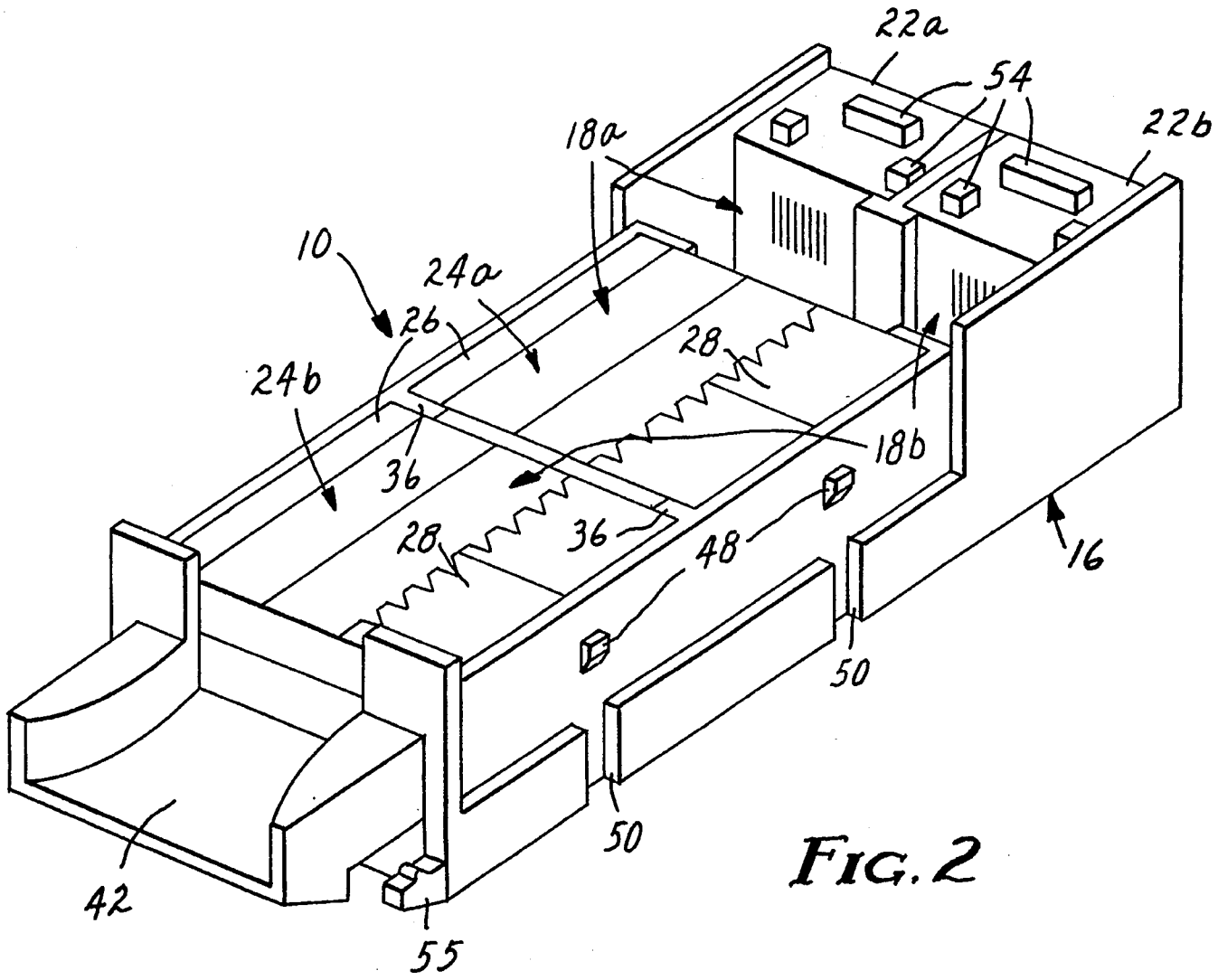
FIG. 2 is a rear perspective view of the RTM of the present invention showing the cover of the housing removed and the termination blocks in their storage position.
Figure 3:
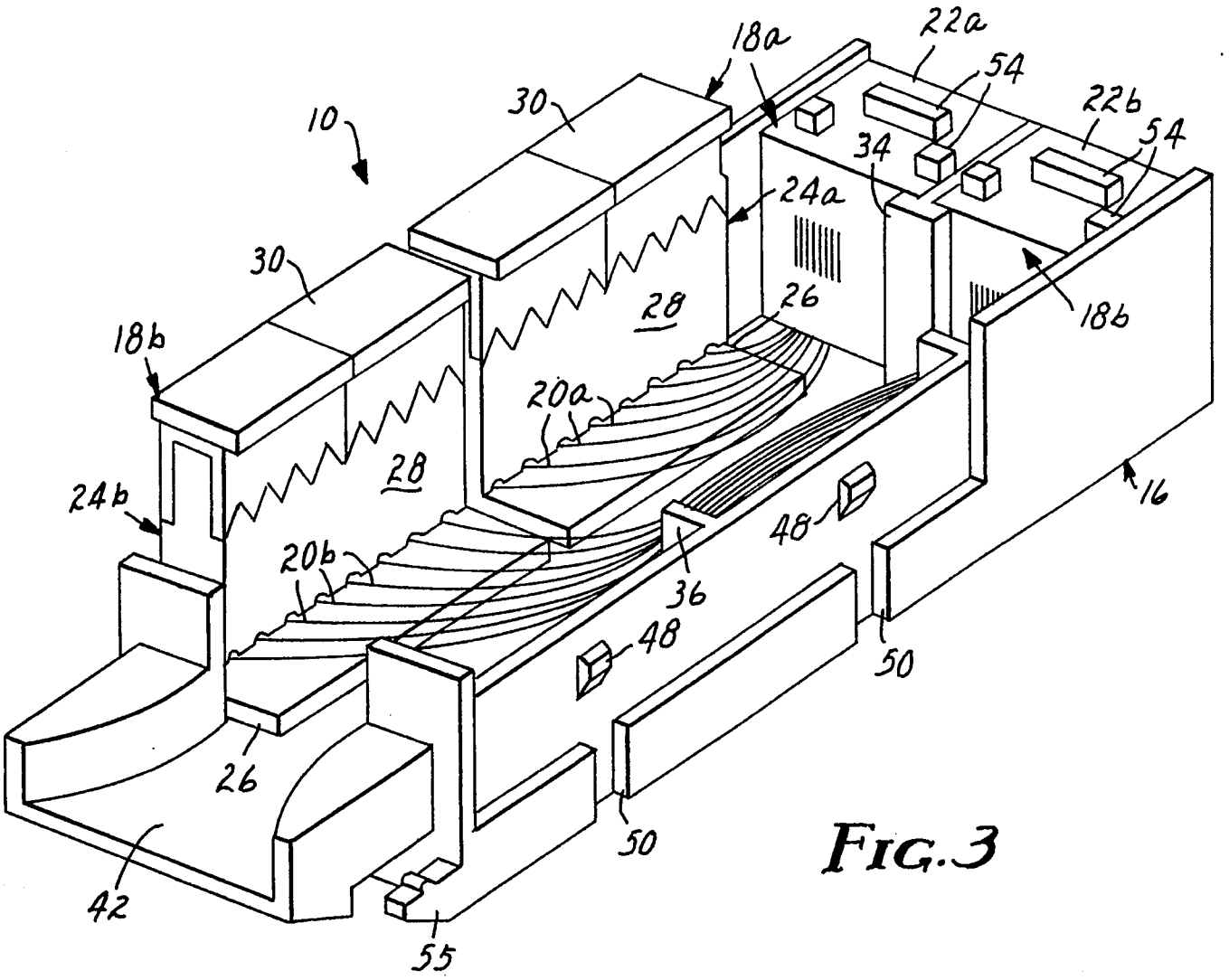
FIG. 3 is a rear perspective view of the RTM of the present invention similar to that of FIG. 2 but the termination blocks are shown in their installation position.

With reference now to the figures, and in particular with reference to FIGS. 1–3, there is depicted one embodiment 10 of the repositionable termination module (RTM) of the present invention. RTM 10 is generally comprised of a housing 12 having a cover 14 and a base 16, and at least one connector assembly inside the base. In the presently preferred embodiment, module 10 houses two connector assemblies **18*a* and 18*b* (more clearly shown in FIG. 4), each having a plurality of jumper wires 22*a* and 22*b* preterminated (factory terminated) at one end in receptacles or jacks 22*a* and 22*b*, respectively, and preterminated at the other end in termination blocks 24*a* and 24*b*, respectively. While the design of the receptacles and termination blocks may vary considerably, in the embodiment shown the receptacles take the form of a snap-in telephone jack, such as an "RJ45" modular jack, and the termination blocks take the form of a "110**" connector. This connector is described in U.S. Pat. Nos. 3,798,587, 4,118,095 and 4,964,812, and is available from American Telephone & Telegraph Co.

As more thoroughly discussed in the above patents, each termination block is generally comprised of a wiring block 26, a connector block 28 and a cap 30. Wiring block 26 has a plurality of posts or strain relief members which hold one end of the wires in place, while connector block 28 is lowered onto wiring block 26. As connector block 28 is so lowered, the metallic contacts at the lower (preterminated) edge thereof cut through the insulation surrounding the wires, securing the wires and making electrical contact with each of the wires, respectively. Each of the metallic contacts has a second end, which passes through connector block 28 and extends toward caps 30, also acting as insulation displacement connectors, for receiving the incoming conductors which are to be routed through receptacles **22*a* and 22*b*. This upper (installation) edge of connector block 28 may also include posts or strain relief members to temporarily secure the incoming conductors prior to cap 30 being placed on connector block 28. When cap 30 is snapped onto the installation edge of connector block 28, it forces the wires into the U-shaped end of the metallic contacts. Alternatively, caps 30 may include a plurality of wire-receiving holes which prelocate the wires with respect to the contacts in terminal blocks 28. The incoming wire ends should be trimmed after connection. All of the components of termination blocks 24***a* and 22*b* may be made of any durable, electrically insulative material, preferably a polymer such as polycarbonate.

FIGS. 2 and 3 illustrate the storage and installation positions, respectively, of the termination blocks. In FIG. 3, the termination blocks are raised at a 90° angle with respect to base 16 of housing 12. This greatly simplifies installation of the incoming conductors since the caps 30 may now be easily removed and refitted onto connector blocks 28. In FIG. 2, the termination blocks have been rotated downwardly to be generally parallel with base 16. Due to the planar design of termination blocks 24*a* and 24*b*, RTM 10 may have a very low profile when the termination blocks lie flat within base 16 in the storage position. It will also be appreciated that, in this position, termination blocks 24*a* and 24*b* serve to isolate wires 20*a* and 20*b* from the rest of the module, thereby protecting them from accidental damage (the incoming field conductors are also isolated—see FIG. 5). In this regard, it will further be appreciated that wiring block 26 is wider than the thickness of the termination blocks, whereby wiring block 26 forms a foot or flange. Since wiring block 26 is positioned generally perpendicular to connector block 28, this foot stabilizes the termination blocks during the installation operation, and also ensures a clearance space for the wires between the termination blocks and the inner surface of base 16 when the blocks are in the storage position.

Figure 4:
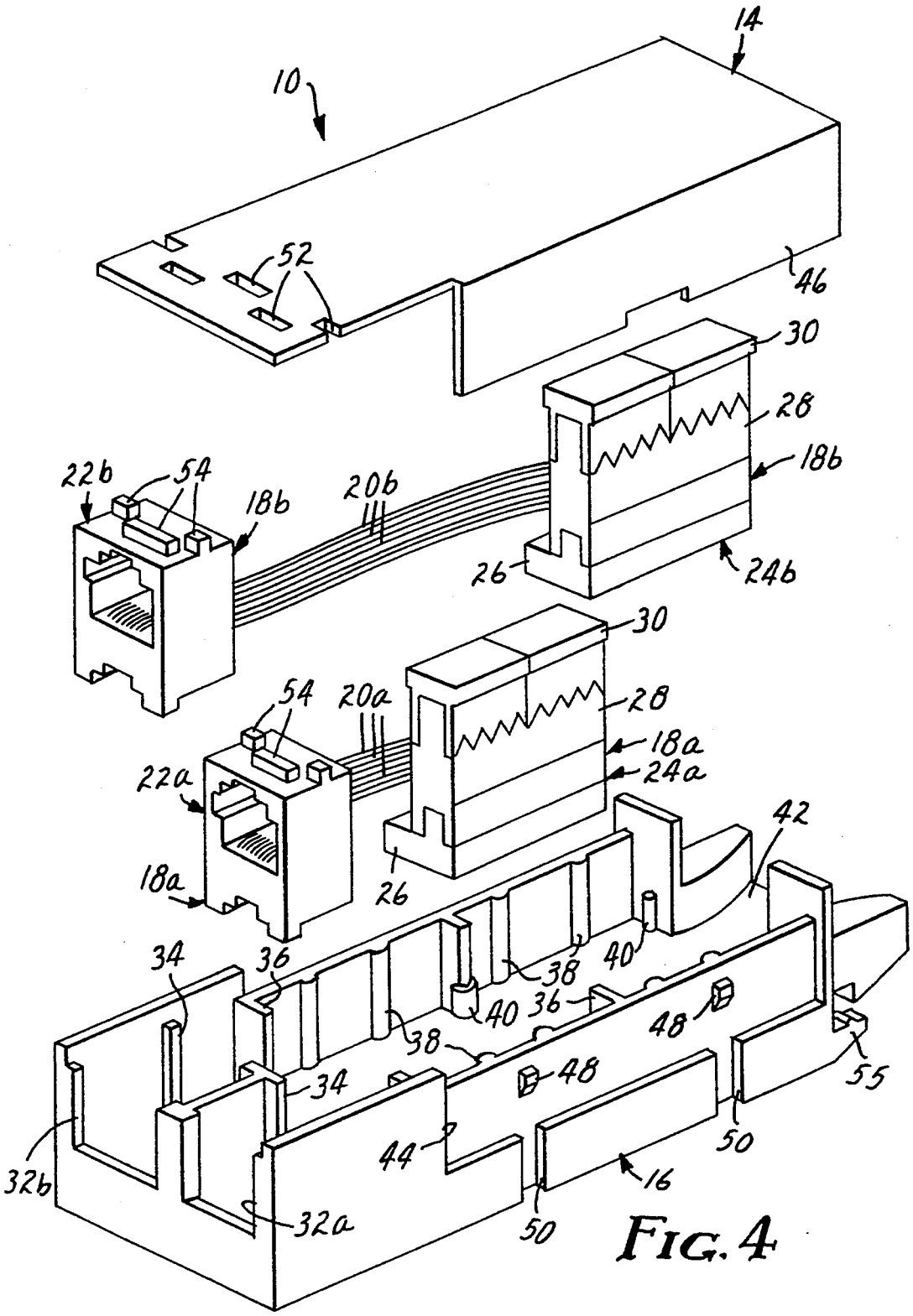
FIG. 4 is an exploded perspective view of the RTM of the present invention.

As seen in FIG. 4, the connector assemblies 18*a* and 18*b* are completely removable from housing 12. This facilitates the repair, replacement or reconfiguration of the connector assemblies. In this regard, it will be appreciated that the termination blocks may not only be moved between the installation and storage positions, but may further be raised slightly away from base 16 without the necessity of removing the entire connector assembly. This makes it easier to use a tool, e.g., arc-joint pliers, to actuate the cap if higher forces are necessary for the insulation displacement contacts to cut through the wire insulation; this may be required when using certain wires, such as those having fluoropolymer based insulation. Removable connector assemblies also provide varying connector path configurations while maintaining constant color code placement for field cable conductors.

The surface features of cover 14 and base 16 are also most visible in FIG. 4. The front of base 16 has two openings 32*a* and 32*b* for receiving jacks 22*a* and 22*b*, respectively. Ribs 34 integrally formed along the inner wall of base 16 help to maintain the receptacles in the proper position. Flanges 36, also integrally formed with base 16, define the storage locations for termination blocks 18*a* and 18*b*. Additional ribs 38 are spaced and sized to provide frictional engagement of the termination blocks when in the storage position, and ensure that the blocks can be placed in this position only when caps 30 are fully engaged onto connector blocks 28. The frictional engagement of the termination blocks prevents detachment of the caps, and this tight fit also assures complete wire insertion in the metallic contacts since the termination blocks cannot fit into the storage position unless the caps are fully engaged on the connector blocks. Side ribs 40 provide additional engagement, and also serve to engage and stabilize the termination blocks during installation of the field conductors. This arrangement of flanges and ribs provides improved resistance to vibrations which might otherwise cause "opens" in the connections.

Besides openings 32*a* and 32*b*, the only other access to the interior of housing 12 is an entrance channel 42 for receiving the incoming field conductors. Channel 42 is flared to ease placement of the conductors. The sides of base 16 preferably includes recesses 44 which follow the contour of the downwardly extending portions 46 of cover 14. Retention anchors 48 may be formed along the recessed portion of the base sidewalls to mate with depressions in the inner surface of portions 46 of cover 14, to provide a snap fit. Notches 50 are accordingly formed in the base sidewalls in order to facilitate removal of the cover by inserting an pointed instrument at notches 50 to lift cover portions 46 off of anchors 48. Cover 14 may also be provided with several holes 52 which receive various protrusions 54 at the tops of receptacles 22*a* and 22*b*, serving to further retain the receptacles in their proper positions (base 16 may also have such holes to receive other protrusions on the underside of receptacles 22*a* and 22*b*). This provides additional strain relief to resist pulling forces on the telephone cable which is connected to the RJ45 jacks, by more equally distributing these forces. Finally, clips 55 may be provided to allow RTM 10 to detachably mount to an external frame. The base and cover of housing 12 may be formed of any durable material, preferably a polymer such as modified polyphenylene oxide.

Figure 5:
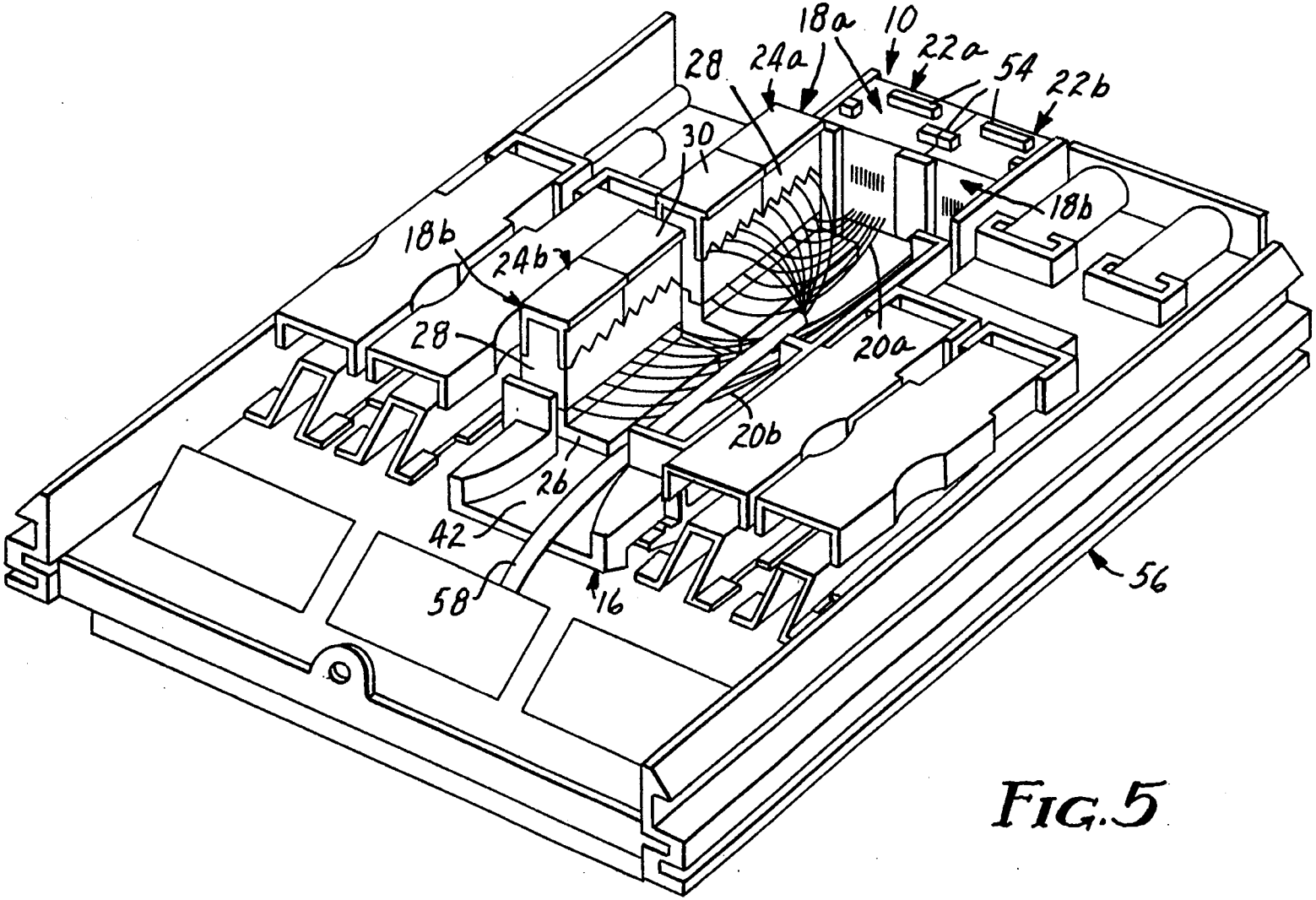
FIG. 5 is a perspective view of the RTM of the present invention as installed in a composite media housing.

Referring now to FIG. 5, it can be seen that the RTM 10 of the present invention may easily be adapted to mixed-media housings, such as for a fiber termination module 56. See, e.g., U.S. Pat. Nos. 4,986,626 and 4,986,762 and 5,052,775, which describe fiber termination modules for various simplex (ST) and duplex (FDDI) fiber optic connectors, which interconnect respective pairs of optical fibers. In FIG. 5, the splice on termination block 24*a* is shown completed with incoming field conductors from a distribution cable 58. The entire RTM 10 (i.e., housing 12) may be mounted to module 56 (such as by clips 55) to allow upward tilting of housing 12, which permits connection of a telephone plug into the jacks without disrupting adjacent modules, particularly the optical fiber cables connected to the fiber optic connectors. Those skilled in the art will appreciate that RTM 10 could also be retrofitted into copper-conductor only systems, such as a protected entrance terminal.

The specific size and shape of RTM 10 and its components may vary considerably depending upon user requirements. It is intended, however, that RTM be very compact, have a low-profile, and be adapted to receive industry standard components, such as the RJ45 jack and 110 connector. Based on these considerations, the following approximate dimensions on considered exemplary. The overall length of base 16, including the extension forming channel is 11.3 cm, while its width and height are 3.6 cm and 2.2 cm, respectively. Openings 32*a* and 32*b* are 1.4 cm×1.2 cm. Flanges 36 are separated by a distance of 3.3 cm, and channel 42 narrows from a width of 2.5 cm to an entrance width of 1.6 cm. The clearance space afforded the incoming wires depends upon the width of the foot formed by wiring block 26, which is preferably 0.5 cm wider than the thickness of connector block 28.

The interconnection module described herein is particularly useful for field termination of transmission line conductors, but still allows remateable attachment of connectorized distribution lines. This invention has several advantages over the prior art. First, this design greatly improves the ergonomics of the installation operation by providing temporary relief from housing obstructions. The repositionable attribute of the termination blocks also imparts a low-profile to the overall RTM. Finally, the disclosed embodiment further provides security isolation of both the jumper wires and the incoming conductors. No prior art reference describes this approach or recognizes the improvements provided by repositioning the termination block after connection of the field cable conductors.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, various connectors and receptacles could be substituted for the specific 110 connector and RJ45 jacks illustrated herein. It is also conceivable that the repositionable termination block could take the form of a multi-fiber splice block in a fiber optic connector. It is therefore contemplated that such modifications can be made without departing from the spirit or scope of the present invention as defined in the appended claims.

I claim:

1. An article for interconnecting a plurality of incoming conductors to a field connector, comprising:

a housing having at least one opening;

receptacle means located in said opening of said housing for receiving the field connector;

a plurality of jumper wires located in said housing, each of said wires having a first end and a second end, said first ends being attached to said receptacle means; and termination means, located within said housing, for interconnecting said second ends of said jumper wires to the ends of the incoming conductors, said termination means being movable between a storage position and an installation position, said housing supporting said termination means in both said storage and installation positions, and said termination means including a termination block positioned in said housing to define a clearance space, said jumper wires being isolated in said clearance space when said termination means is in said storage position, said termination block comprising a connector block having a lower edge and an upper edge, and having a plurality of metallic contacts, each of said metallic contacts having a first end located at said lower edge and a second end located at said upper edge, said connector block being generally planar and having a thickness;

a wiring block having means for retaining said second ends of said jumper wires, said wiring block being connected to said connector block whereby said second ends of said jumper wires are electrically connected to said first ends of said metallic contacts, respectively, said wiring block being generally planar and positioned perpendicular to said connector block, and having a width which is greater than said thickness of said connector block, defining a foot portion of said wiring block, said foot portion creating said clearance space when said termination block is placed generally parallel to a bottom surface of said housing; and a cap including means for forcibly urging the ends of the incoming conductors against said second ends of said metallic contacts, respectively.

2. The article of claim 1 wherein said housing includes a base and a cover removably attached to said base.

3. The article of claim 1 wherein said housing has an entrance channel therein for receiving the incoming conductors.

4. The article of claim 1 wherein said housing includes means for detachably mounting said housing to an external frame.

5. The article of claim 1 wherein said receptacle means, said jumper wires and said termination means collectively comprise a connector assembly which is removably attached to an interior space of said housing.

6. The article of claim 1 wherein said receptacle means comprises a telephone jack.

7. A composite media termination module utilizing the article of claim 1, comprising:

at least one fiber termination module having means for interconnecting a pair of optical fibers; and mixed-media housing means for retaining said fiber termination module and the article of claim 1.

8. The article of claim 2 wherein:

said termination block is generally planar; and said base includes flange means for defining said storage position.

9. An article for interconnecting a plurality of incoming conductors to a field connector, comprising:

a housing having at least one opening and a bottom surface;

receptacle means located in said opening of said housing for receiving the field connector;

a plurality of jumper wires located in said housing, each of said wires having a first end and a second end, said first ends being attached to said receptacle means; and termination means, located within said housing and movable between a storage position and an installation position, for interconnecting said second ends of said jumper wires to the ends of the incoming conductors, said termination means including means for defining a clearance space within said housing, said jumper wires being isolated in said clearance space when said termination means is in a storage position, and said terminations means further including a connector block which is generally perpendicular to said bottom surface of said housing when said termination means is in said installation position, and which is generally parallel to said bottom surface of said housing when said termination means is in said storage position.

10. The article of claim 9 wherein said termination block comprises:

a connector block having a lower edge and an upper edge, and having a plurality of metallic contacts, each of said metallic contacts having a first end located at said lower edge and a second end located at said upper edge;

a wiring block having means for retaining said second ends of said jumper wires, said wiring block being connected to said connector block whereby said second ends of said jumper wires are electrically connected to said first ends of said metallic contacts, respectively; and a cap including means for forcibly urging the ends of the incoming conductors against said second ends of said metallic contacts, respectively.

11. The article of claim 9 wherein said receptacle means, said jumper wires and said termination means collectively comprise a connector assembly which is removably attached to an interior space of said housing.

12. A composite media termination module utilizing the article of claim 9, comprising:

at least one fiber termination module having means for interconnecting a pair of optical fibers; and mixed-media housing means for retaining said fiber termination module and the article of claim 13.

13. The article of claim 10 wherein said wiring block is generally planar and positioned perpendicular to said connector block, and has a width which is greater than the thickness of said connector block, defining a foot portion of said wiring block, said foot portion creating said clearance space when said termination block is placed generally parallel to a bottom surface of said housing.

14. A repositionable termination module for interconnecting a plurality of incoming conductors to a field connector, comprising:

a housing having a base and a cover removably attached to said base, defining at least one opening and an entrance channel for receiving the incoming conductors, said housing further having means for detachably mounting said housing to an external frame;

a receptacle located in said opening of said housing, adapted to mate with the field connector;

a plurality of jumper wires located in said housing, each of said wires having a first end and a second end, said first ends being attached to said receptacle;

a termination block, located within said housing, including:

a connector block having a lower edge and an upper edge, and having a plurality of metallic contacts, each of said metallic contacts having a first end located at said lower edge and a second end located at said upper edge, said connector block being generally planar and having a thickness, a wiring block having means for retaining said second ends of said jumper wires, said wiring block being connected to said connector block whereby said second ends of said jumper wires are electrically connected to said first ends of said metallic contacts, respectively, said wiring block being generally planar and positioned perpendicular to said connector block, and having a width which is greater than said thickness of said connector block, defining a foot portion of said wiring block, said foot portion creating a clearance space when said connector block is placed generally parallel to a bottom surface of said base, and a cap including means for forcibly urging the ends of the incoming conductors against said second ends of said metallic contacts, respectively;

wherein:

said termination block, jumper wires and receptacle collectively comprise a connector assembly which is removably attached to an interior space of said housing; and said termination block is movable between a storage position and an installation position, said connector block being generally perpendicular to said bottom surface of said base when said termination block is in said installation position, and said connector block being generally parallel to said bottom surface of said base when said termination block is in said storage position.

* * * * *